US007373761B2

(12) United States Patent
Stahl, Sr.

(10) Patent No.: US 7,373,761 B2
(45) Date of Patent: May 20, 2008

(54) SELF-ADJUSTING INTUMESCENT FIRESTOPPING APPARATUS

(75) Inventor: James P. Stahl, Sr., Stockton, NJ (US)

(73) Assignee: Specified Technologies Inc., Somerville, NJ (US)

( * ) Notice: Subject to any disclaimer, the term of this patent is extended or adjusted under 35 U.S.C. 154(b) by 510 days.

(21) Appl. No.: 11/020,283

(22) Filed: Dec. 23, 2004

(65) Prior Publication Data

US 2006/0138251 A1 Jun. 29, 2006

(51) Int. Cl.
*E04C 2/52* (2006.01)
*E04C 2/00* (2006.01)
*E04B 1/94* (2006.01)

(52) U.S. Cl. ..... 52/232; 52/220.8; 52/317

(58) Field of Classification Search ..... 52/1, 52/232, 220.8, 317; 174/483
See application file for complete search history.

(56) References Cited

U.S. PATENT DOCUMENTS 4,109,423 A * 8/1978 Perrain ..... 52/1
4,136,707 A * 1/1979 Gaillot et al. ..... 52/232
4,264,779 A 4/1981 Rhodes et al.
4,646,486 A 3/1987 Hauff
4,964,180 A 10/1990 Harbeke
5,257,641 A * 11/1993 Elsbury et al. ..... 52/232
5,301,475 A 4/1994 Stefely
5,331,946 A * 7/1994 Yamini et al. ..... 52/317
5,421,127 A 6/1995 Stefely
6,018,126 A 1/2000 Castellani et al.
6,114,623 A 9/2000 Bonilla et al.
6,175,078 B1 1/2001 Bambardekar et al.
6,307,152 B1 10/2001 Bonilla et al.
6,314,692 B1 11/2001 Munzenberger et al.
6,360,502 B1 * 3/2002 Stahl, Jr. ..... 52/232
6,417,446 B1 7/2002 Whitehead
6,518,498 B1 2/2003 Bonilla et al.
6,536,169 B2 3/2003 Dykhoff
6,551,130 B2 4/2003 Bonilla
6,612,081 B2 9/2003 Cole et al.
6,696,640 B1 2/2004 Castellani et al.
6,718,100 B2 4/2004 Morris
6,720,495 B2 4/2004 Castellani et al.
6,732,481 B2 5/2004 Stahl, Sr.
6,750,395 B2 6/2004 Stout et al.
6,783,345 B2 8/2004 Morgan et al.
6,848,227 B2 * 2/2005 Whitty ..... 52/232
6,969,799 B2 * 11/2005 Snyder ..... 52/220.8
2003/0051423 A1 * 3/2003 Munzenberger ..... 52/220.8

* cited by examiner

*Primary Examiner*—Jeanette Chapman
*Assistant Examiner*—Elizabeth A Plummer
(74) *Attorney, Agent, or Firm*—Sperry, Zoda & Kane

(57) ABSTRACT

A self-adjusting firestopping apparatus for holding of intumescent material within poke-through openings in construction barriers usually being floors but also possibly being walls or ceilings wherein cables or other penetrating members extend therethrough. The self-adjusting apparatus includes a sleeve with the intumescent material centrally located therein and preferably two plates extending along the sleeve and movably attached thereto by a flexibly resilient support device such as a coil spring or flat spring. This plate provides a movable false panel which is adapted to expand responsive to the placement of increasing numbers of penetrating members extending therethrough to increase the capacity of the intumescent firestopping device.

22 Claims, 4 Drawing Sheets

SELF-ADJUSTING INTUMESCENT FIRESTOPPING APPARATUS

BACKGROUND OF THE INVENTION

1. Field of the Invention

A firestopping design is shown in the present invention which is for the purpose of providing intumescent firestopping materials into openings extending through construction barriers such as walls, ceilings or floors. Such intumescent materials expand rapidly responsive to heat and/or fire for the purpose of sealing these openings. Such sealing mechanisms are commonly utilized in residential as well as commercial buildings. The present invention deals with a device which has the capability of providing the correct amount of intumescent material while simultaneously allowing a specific design for the containment sleeve to be usable with a wide range of sizes and numbers of penetrating members. Sometimes such a sleeve is usable for only a single penetrating member of a very small dimension and other times it is usable with multiple penetrating members which can assume a rather large overall accumulative diameter. The present invention allows a single construction to be expandable for use in a wide variety of different poke-through applications. This invention hereby makes specific reference to U.S. Pat. No. 6,732,481, issued May 11, 2004, by the same inventor, applicant and assignee noted herein on an "Intumescent Firestopping Apparatus". The present invention is specifically designed to be a modification of that particular design which includes a wider range of flexibility due to the introduction of self-adjusting movable plates. Applicant hereby expressly incorporates by reference all of the subject matter disclosed in U.S. Pat. No. 6,732,481 for all purposes.

2. Description of the Prior Art

Numerous patents have been issued which deal with intumescent materials used for sealing openings such as poke-through openings in various construction barriers such as shown in U.S. Pat. No. 4,264,779 patented Apr. 28, 1981 to T. Rhodes et al and assigned to General Signal Corporation on a "Poke-Through Electrical Fitting With Releasable Wedging Point For Retention"; and U.S. Pat. No. 4,646,486 patented Mar. 3, 1987 to W. Hauff on a "Flame-Retarding Wall Feedthrough Fitting"; and U.S. Pat. No. 4,964,180 patented Oct. 23, 1990 to G. J. Harbeke on a "Shower Strainer Mounting Assembly"; and U.S. Pat. No. 5,301,475 patented Apr. 12, 1994 to S. F. Stefely on a "Fire Stop Device"; and U.S. Pat. No. 5,421,127 patented Jun. 6, 1995 to S. F. Stefely on a "Fire Stop Closure"; and U.S. Pat. No. 6,018,126 patented Jan. 25, 2000 to N. Castellani et al and assigned to Walker Systems, Inc. on a "Flush Poke-Through Wiring Fitting"; and U.S. Pat. No. 6,114,623 patented Sep. 5, 2000 to N, Bonilla et al and assigned to Hubbell Incorporated on a "Poke-Through Floor Fitting"; and U.S. Pat. No. 6,175,078 patented Jan. 16, 2001 to S. Bambardekar et al and assigned to Walker Systems, Inc. on a "Flush Poke-Through Wiring Fitting Having A Height Adjustable Data Jack Mounting Bracket"; and U.S. Pat. No. 6,307,152 patented Oct. 23, 2001 to N. Bonilla et al and assigned to Hubbell Incorporated on a "Poke-Through Floor Fitting"; and U.S. Pat. No. 6,314,692 patented Nov. 13, 2001 to H. Munzenberger et al and assigned to Hilti Aktiengesellschaft on a "Lead-In System For Ceilings And Walls Including Trapezoidally Corrugated Sheet Metal Framework"; and U.S. Pat. No. 6,417,446 patented Jul. 9, 2002 to J. H. Whitehead and assigned to Thomas & Betts International, Inc. on a "Concealed Service Poke-Through Device"; and U.S. Pat. No. 6,518,498 patented Feb. 11, 2003 to N. Bonilla et al and assigned to Hubbell Incorporated on a "Poke-Through Floor Fitting With Thermally Activated Conductor Links"; and U.S. Pat. No. 6,536,169 patented Mar. 25, 2003 to M. G. Dykhoff and assigned to 3M Innovative Properties Company on an "Adjustable Rack For Supporting Firestop Material In A Through-Penetration"; and U.S. Pat. No. 6,5531,130 patented Apr. 22, 2003 to N. Bonilla and assigned to Hubbell Incorporated on a "4×8 Fire Rated Poke Through Fitting"; and U.S. Pat. No. 6,612,081 patented Sep. 2, 2003 to M. T. Cole et al and assigned to Walker Systems, Inc. on a "Water-Tight Cover Assembly For An In-Floor Fitting"; and U.S. Pat. No. 6,696,640 patented Feb. 24, 2004 to N. Castellani et al and assigned to Walker Systems, Inc. on a "Quad Receptacle, Dual Circuit Flush Poke-Through Wiring Fitting With Internally Mountable Communication/Data Jacks"; and U.S. Pat. No. 6,718,100 patented Apr. 6, 2004 to Dd. D. Morris and assigned to Milliken & Company on a "Fire Resistant Conduit Insert For Optical Fiber Cable"; and U.S. Pat. No. 6,720,495 patented Apr. 13, 2004 to N. Castellani et al and assigned to Walker Systems, Inc. on a "Quad Receptacle, Dual Circuit Flush Poke-Through Wiring Fitting With Internally Mountable Communication/Data Jacks"; and U.S. Pat. No. 6,732,481 patented May 11, 2004 to J. P. Stahl, Sr. and assigned to Specified Technologies Inc. on an "Intumescent Firestopping Apparatus"; and U.S. Pat. No. 6,750,395 patented Jun. 15, 2004 to J. B. Stout et al and assigned to Walker Systems, Inc. on a "Poke-Thru Fitting Having Polymeric Based Intumescent Material"; and U.S. Patent Application Publication No. US2004/0128927 A1 published Jul. 8, 2004 to M. T. Cole on an "Integrated Ceiling And Wireway Distribution System" and U.S. Pat. No. 6,783,345 patented Aug. 31, 2004 to M. D. Morgan et al and assigned to W.R. Grace & Co.-Conn on "In Situ Molded Thermal Barriers"; and U.S. Design Pat. No. D498, 211 patented Nov. 9, 2004 to S. C. Thibault and assigned to The Wiremold Company on a "Surface Mounted Electrical Cable Way".

SUMMARY OF THE INVENTION

A unique configuration for a self-adjusting intumescent firestopping apparatus is shown in the present invention. This apparatus is designed for the selective sealing of an opening normally positioned in a construction barrier such as a wall, ceiling or floor when it is desired for penetrating members to extend therethrough for various purposes. Such penetrating members include computer cables, electrical cables, plumbing fixtures, water lines, gas lines and many other penetrating conduits usable for various purposes.

The basic construction includes a sleeve securable to the construction barrier at a position extending through the opening defined therein for the purpose of defining an access corridor therein for receiving of the penetrating members extending therethrough. This corridor extends through the construction barrier. The sleeve is preferably made from a plurality of individual panels which together define the access corridor therebetween. Preferably four such panels are used such that the sleeve means is of a rectangular or more particularly square cross-sectional configuration. One of the panels preferably comprises an upper wall member which is positioned generally above the access corridor and the penetrating members extending therethrough therebelow. Another panel also includes a lower wall member positioned generally below the upper wall member and also below the access corridor and penetrating members extending therethrough.

At least one plate and preferably two individual plates are included which extend along the panels and are movably attached with respect to the panels. These plates are positioned spatially disposed from the panel members and include an outer surface facing the panel member and an inner surface defined oppositely therefrom facing inwardly. The inner surface of the plate along the panel members defines the access corridor therebetween. In the preferred configuration wherein two plates are utilized a first plate member is included movably attached with respect to the upper wall member and extending along the panel of the sleeve at a position spatially disposed therefrom and movably attached to it. The first plate member preferably includes a first outer surface and a first inner surface defined oppositely with respect to one another. This first plate member is movable in a direction which is defined to be approximately vertical relative to the upper wall member.

In a similar manner a second plate member may be movably attached with respect to the lower wall member such that it extends along the sleeve at a position spatially disposed from one of the panels thereof and movably attached relative thereto. This second plate is preferably positioned oppositely from the first plate on the other side thereof from the penetrating members such that the penetrating members are positioned therebetween. This second plate member includes a second inner surface facing the penetrating members and a second outer surface facing the adjacent portion of the sleeve. In this manner the first inner surface of the first plate member and the second inner surface of the second plate member along with the adjacently positioned panel members of the sleeve will define the access corridor therebetween which is for the purpose of receiving penetrating members extending therethrough. The second plate member is preferably movable in a direction approximately vertically upwardly with respect to the lower wall member.

An intumescent sealing means is preferably included positioned between the inner surface of the first plate means and the inner surface of the second plate means. This intumescent sealing means can include an upper intumescent pad secured to the first plate member and a lower intumescent pad secured to the second plate member. In this manner surrounding engagement of these pads with respect to the penetrating members extending through the corridor located therebetween can be facilitated.

The present invention further preferably includes a flexibly resilient support which is attached with respect to the outer surface of the plate and is positioned extending between at least one of the panel members in the outer surface of the plate in order to facilitate flexible resilient mounting of the plate with respect to the sleeve. The flexibly resilient support will be adapted to exert force against the outer surface of the plate to urge the inner surface of the plate into abutment with respect to the intumescent sealing material for urging thereof into abutment with respect to penetrating members extending through the access corridor to facilitate sealing therearound especially when exposed to excessive heating or fire. The particular configuration of the flexibly resilient support will be the inclusion of an upper spring mounted to the upper wall member and extending downwardly therefrom. This upper spring is also secured to the first outer surface of the first plate member to facilitate flexibly resilient mounting thereof with respect to the sleeve. In the preferred configuration the upper spring will comprise a coil spring but it also can comprise leaf springs, flat springs or any other flexibly resilient support means.

Similarly a lower spring may be included mounted to the lower wall member and extending upwardly therefrom. This lower spring is also secured to the second outer surface of the second plate member to facilitate flexibly resilient mounting thereof with respect to the sleeve. The lower spring preferably includes a plurality of coil springs but can also be configured as a flat spring or leaf spring or any other flexibly resilient mechanism.

Preferably the present invention will also include a stopping means which is preferably attached with respect to the sleeve and is adapted to engage the first and second plate members to limit the extent of movement thereof away from the adjacent panel means to limit the amount of opening of or movement of the springs away from the fully collapsed position. This stop means will also establish a minimum dimension for the access corridor which is achieved when the upper and lower springs are both extended to the maximum possible movement.

An upper overlapping flange member can be included extending downwardly from the upper wall member to seal the portion of the sleeve extending between the first outer surface of the first plate member and the upper wall member. Similarly a lower overlapping flange can be included extending upwardly from the lower wall member to seal the portion of the sleeve extending between the second outer surface of the second plate member and the second lower wall member.

To further enhance operation of the present invention an upper biasing mechanism can be included positioned between the lower surface of the upper plate member and the upper intumescent pad to exert downwardly directed bias against the upper intumescent pad from the first plate to facilitate engagement thereof with respect to the penetrating members extending around the opening for enhancing retaining thereof. Similarly a lower biasing mechanism can be included positioned between the upper surface of the second plate member and the lower intumescent pad to exert upwardly directed bias against the lower intumescent pad directed from the second plate to facilitate engagement thereof with respect to the penetrating members extending around the opening for enhancing retaining thereof and more effectively achieving intumescent sealing thereof responsive to excessive heat or fire.

It is an object of the intumescent firestopping apparatus of the present invention to be self-adjusting.

It is an object of the self-adjusting intumescent firestopping apparatus of the present invention to selectively seal an opening in a construction barrier such as a wall, ceiling or floor having penetrating members extending therethrough.

It is an object of the present invention to provide a self-adjusting intumescent firestopping apparatus for selectively sealing of an opening in a construction barrier having penetrating members which is capable of supporting the weight of penetrating cables extending therethrough.

It is in object of the present invention to provide a self-adjusting intumescent firestopping apparatus for selectively sealing of an opening in a construction barrier having penetrating members which can seal off a construction opening without requiring the manual installation or manipulation of the seal in any manner because it is automatic.

It is an object of the present invention to provide a self-adjusting intumescent firestopping apparatus for selectively sealing of an opening in a construction barrier having penetrating members which permits installation or removal of cables or other similar penetrating members without requiring removal or re-installing of firestopping members.

It is an object of the present invention to provide a self-adjusting intumescent firestopping apparatus for selectively sealing of an opening in a construction barrier having penetrating members which has a wide degree of variation in capacity.

It is an object of the present invention to provide a self-adjusting intumescent firestopping apparatus for selectively sealing of an opening in a construction barrier having penetrating members which is capable of allowing numerous large penetrating members to extend therethrough or only a single small penetrating member to extend therethrough.

It is an object of the present invention to provide a self-adjusting intumescent firestopping apparatus for selectively sealing of an opening in a construction barrier having penetrating members which will occupy its own space within the hole in the wall without displacing cables.

It is an object of the present invention to provide a self-adjusting intumescent firestopping apparatus for selectively sealing of an opening in a construction barrier having penetrating members which can be effectively used for walls as horizontal barriers as well as in ceilings and in floors as vertical barriers.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION FO THE PREFERRED EMBODIMENT

Figure 1:
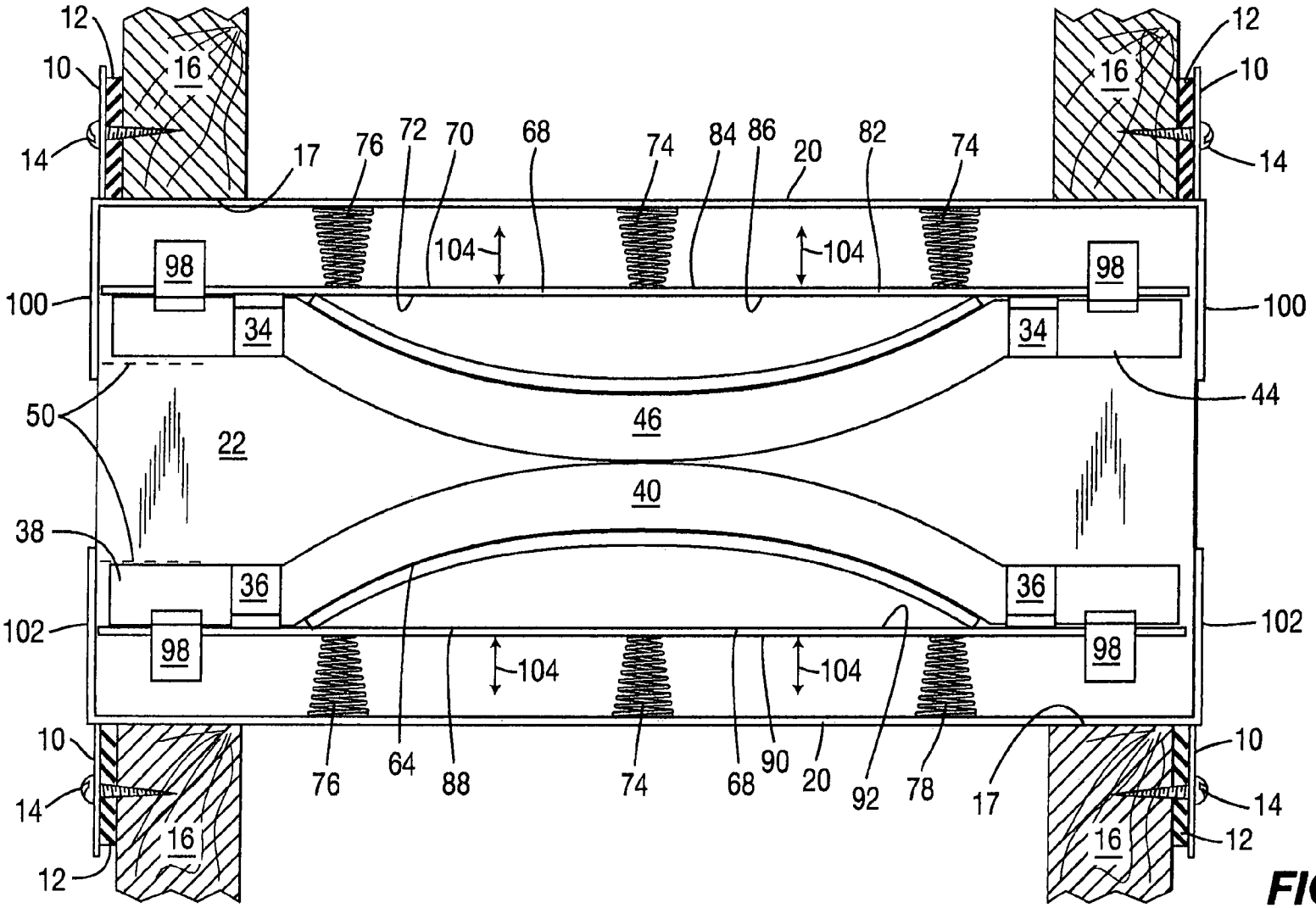
FIG. 1 is a side cross sectional view of an embodiment of the self-adjusting intumescent firestopping apparatus of the present invention shown with the upper and lower plate support springs in the fully extended position.

The present invention provides a cabling pathway design which is a distinct improvement over a somewhat similar older design shown in U.S. Pat. No. 6,732,481 issued May 11, 2004 to James P. Stahl, Sr. The present application provides an apparatus which significantly increases the cable capacity of such pass through devices. In the original design the pathway makes use of intumescent foam pads which are cut longer than the pathway and then are compressed in such a manner as to form arches which meet in the middle of the pathway. The present invention, however, provides a means where such pads are mounted onto resiliently movable plates 68 within the pathway which are supported by flexibly resilient support means 74 against the upper wall member 26 and the lower wall member 28.

With intumescent firestopping sleeve designs such as the present invention, a critical relationship exists between the length of the pads and the overall length of the sleeve. Increasing of the height of the inner chamber of the pathway correspondingly requires an increase in the length of the pads in order to increase the height of the arches which are also referred to as the upper central pad section 46 and the lower central pad section 40. This increasing requires more length of the pathway as well as increasing the length and height of the intumescent foam pads. When cables are inserted into the wire way in contact with the pads it is possible that they can drag the pads toward the opposite end which rolls the protruding pad sections 40 and 46 toward the opposite end from insertion which is undesirable. The present invention provides an apparatus which overcomes these problems by providing movable plates 68 which are spring mounted relative to the walls of the sleeve 20 which thereby allows the intumescent pads 38 and 44 to be flexibly mounted relative to the penetrating members 18 which is particularly useful as they are placed through the opening 17 into the access corridor or throat 22 defined therewithin.

This embodiment of the invention provides for an increased pathway height and volume while at the same time maintaining the overall geometry of the pads as set forth in the '481 patent. The pads 38 and 44 are affixed to these resiliently movable plates 68 and particularly first plate member 82 thereabove and second plate member 88 therebelow such that the pads themselves can easily move up or down to increase or decrease the spacing therebetween to vary the size of the access corridor 22 or throat which is adapted to receive one or more penetrating members or cables 18.

Figure 2:
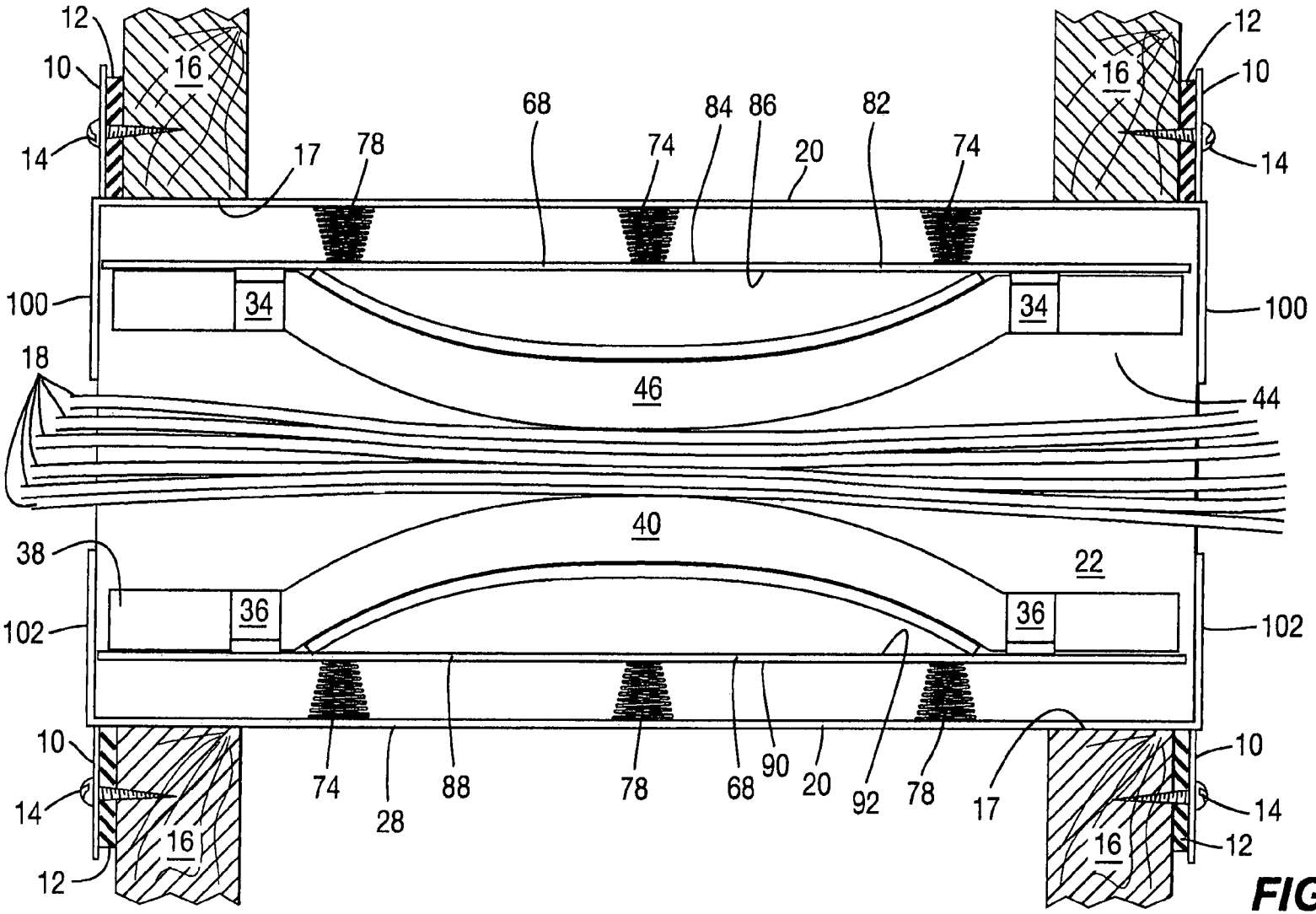
FIG. 2 is an illustration of the embodiment shown in FIG. 1 with penetrating members positioned therethrough and the upper and lower plate support springs shown in the partially collapsed position.
Figure 3:
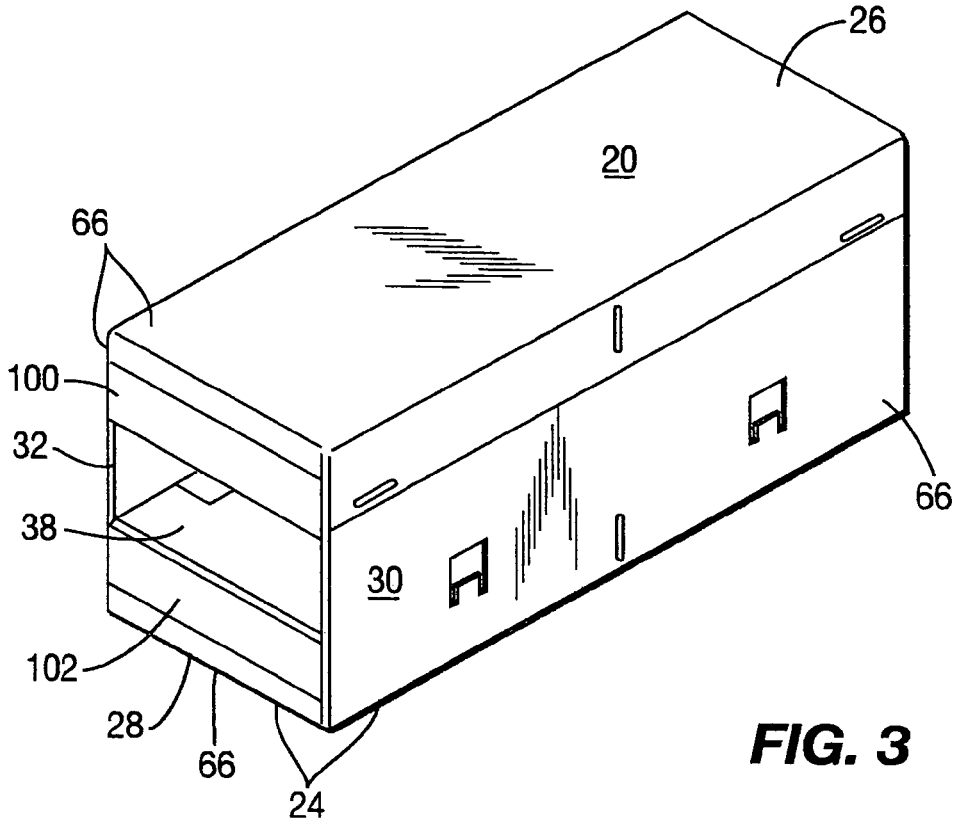
FIG. 3 is a perspective illustration of an embodiment of the present invention showing the external facing portions thereof.
Figure 4:
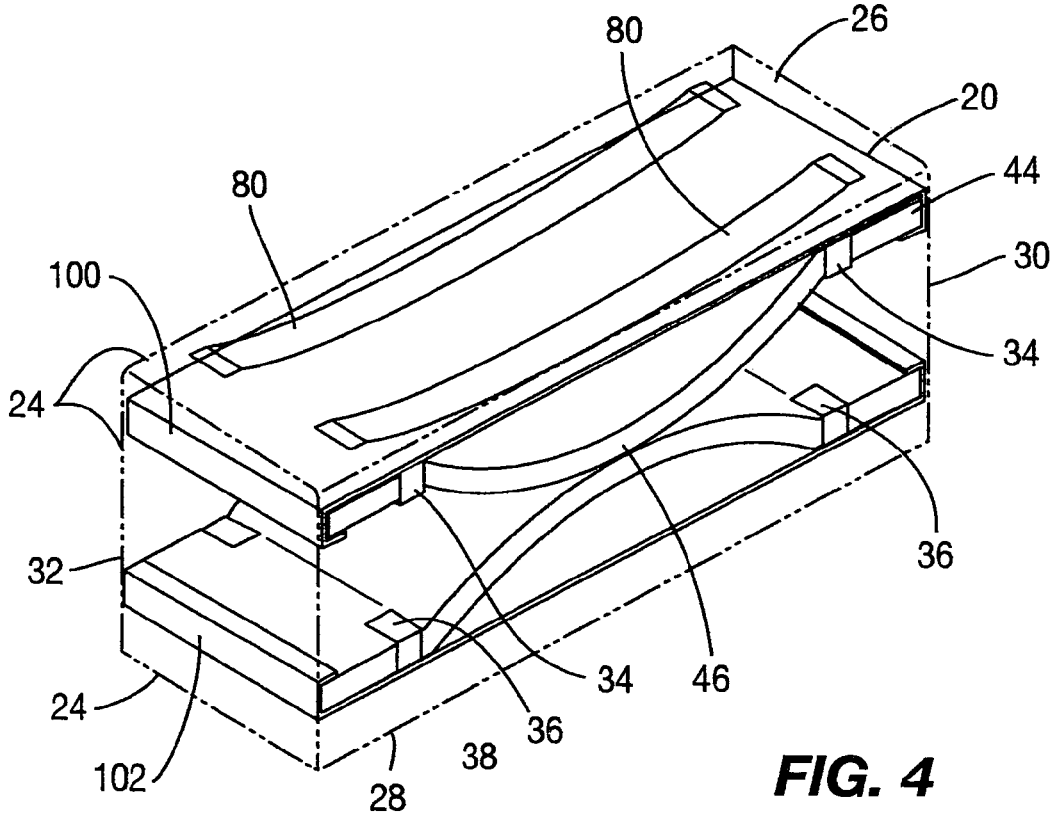
FIG. 4 is a broken away perspective illustration of an embodiment of the self-adjusting intumescent firestopping apparatus of the present invention.
Figure 5:
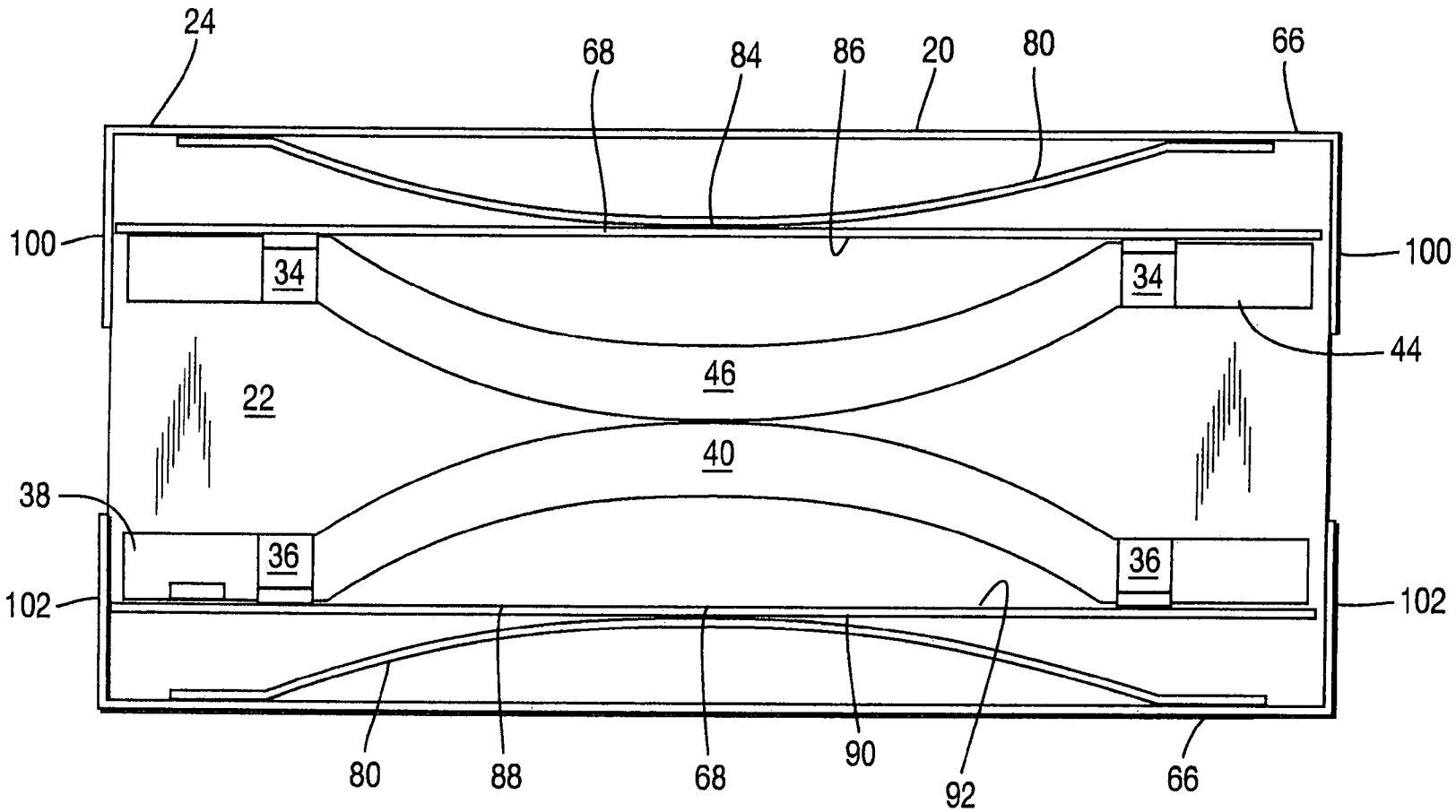
FIG. 5 is a side cross sectional view of an alternative embodiment of the self-adjusting intumescent firestopping apparatus of the present invention showing the use of leaf springs rather than coil springs as the flexibly resilient support devices for the upper and lower plates.

FIG. 1 shows the apparatus in the steady state position with the lower central pad section 40 of lower pad 38 and the upper central pad section 46 of upper pad 44 touching. This is the steady state relaxed position with the flexibly resilient support means 74 or spring 76 shown as coil spring 78 in the relaxed or fully expanded position. As cables 18 are placed extending through the opening 17 into the access corridor or throat 22 the pad sections 40 and 46 will tend to separate due to the vertical dimension taken up by the one or more conduits which will allow the springs 76 to become somewhat compressed. The configuration shown in FIG. 2 illustrates the springs in the partially compressed configuration with cables 18 extending therethrough. Further compression of springs 76 beyond the position shown in FIG. 2 is possible by the placement of additional cables 18 through the access throat 22. Additional cables will cause the first plate 82 to move upwardly and the second plate 88 to move downwardly as shown in FIG. 2 until the spring means 76 reaches the fully compressed position. Thus the apparatus of the present invention with the resiliently mounted first and second plates 82 and 88 provides significantly enhanced capacity while still being usable with a single small penetrating cable only. FIG. 5 shows a similar design as FIG. 1 which the inclusion however of flat springs rather than the coil springs shown in FIG. 1.

Thus, with the above construction, we can see that the intumescent firestopping apparatus of the present invention with the resiliently mounted plates provides a self-adjusting feature not requiring any specific external adjustment while at the same time significantly increasing the capacity for carrying cables therethrough while at the same time not requiring any specific manual adjustments. This is a significant advantage over the prior and in particular a significant advantage and structural difference over the disclosure shown in the '481 patent.

Generally the apparatus of the present invention includes a mounting plate 10 which extends around the opening 17 in the construction barrier 16. Such construction barrier 16 can comprise a wall, ceiling, floor or any angled roof or any other angled construction panel or barrier 16. The mounting plate 10 is adapted to be secured with respect to the construction barrier 16 by a securement means such as a threaded fastener 14. An external gasket 12 can be positioned therearound between the mounting plate 10 and the construction barrier 16 to facilitate sealing therebetween.

The present invention provides a sleeve 20 with a dynamically adjustable sealing throat designed to receive one or more penetrating members or cables 18 extending therethrough. Sleeve 20 defines an access corridor 22 defined therethrough which provides a throat for receiving of the cables 18.

Preferably the sleeve means 20 will include flat outer sections 24 and is configured in a generally square or rectangular cross section. The sleeve 20 preferably includes an upper wall member 26 and a lower wall member 28 as well as a first side wall member 30 and a second side wall member 32 to provide the overall rectangular or square cross section.

One of the unique enhancements of the apparatus of the present invention is in the inclusion of the mounting plate 10 movably secured by a flexibly resilient support means 74 with respect to one or more of the panel members 66. The panel members 66 in the configuration shown in this embodiment comprise the two side wall members 30 and 32 as well as the upper and lower wall members 26 and 28. The plate means 68 being preferably secured with respect to the flexibly resilient support means 74 will be movably mounted with respect to the sleeve 20 and, in particular, with respect to the panel members 66. Each of the individual plate means 68 preferably defined as the first plate member 82 and the second plate member 88 will include an intumescent pad means 38 mounted thereon. In particular the first plate member 82 will define a first outer surface 84 facing the upper wall member 26 and a first inner surface 86 facing the penetrating members 18 immediately thereadjacent. Similarly the second plate member 88 will define a second outer surface 90 facing the lower wall member 28 and a second inner surface 92 facing the penetrating members 18 extending through the access corridor 22. With this configuration the flexibly resislient support means 74 will be configured as a spring means 76 and more preferably as coil springs 78. These springs 76 will provide movable mounting of the first plate member 82 and the second plate member 88 with respect to the upper wall member 26 and the lower wall member 28.

The lower intumescent pad 38 will preferably be secured with respect to the second inner surface 92 of the second plate member 98. Similarly the upper intumescent pad member or means 44 will be secured or somehow attached with respect to the first inner surface 86 of the first plate member 82. As such, each of the lower intumescent pad means 38 and the upper intumescent pad means 44 will be flexibly and resiliently movably mounted relative to the access corridor or throat 22 extending therethrough and more particularly with respect to the penetrating cable members 18 extending therethrough. Securement of the upper intumescent pad 44 with respect to the first inner surface 86 and first plate member 82 will be achieved by an upper tab means 34 which defines a confinement area 50 between it and the adjacent first inner surface 86. The upper intumescent pad 44 will be capable of being held therein. An upper central pad section 46 of the foam intumescent pad configuration will be curved and extend downwardly to facilitate engagement thereof with respect to and intumescent sealing around penetrating cables 18 therebelow.

Similarly a lower tab means 36 can defines the confinement area 50 between it and the second inner surface 92 of second plate member 88. This lower tab means 36 is preferably mounted to the second plate member 18 such as to define this confinement area 50 between it and the tab itself. This confinement area adjacent to the second plate member 88 will be defined to receive and retain a portion of the lower intumescent pad means 38 therebetween. The lower intumescent pad means 38 will also include a lower central pad section 40 extending upwardly therefrom and capable of engaging the upper central pad section 46 when the apparatus of the present invention is in the relaxed or steady state position prior to the placement of cables therethrough. In this manner when cables 18 are positioned therethrough they will be surrounded and engaged by the upper and lower intumescent pad means 44 and 38 respectively.

The present invention is usable with at least one plate means 68, however all of the embodiment show the use of two individual plate means. However, it should be appreciated that a single plate means 68 can be provided with a single outer surface 70 and a single inner surface 72 with an intumescent pad mounted with respect to the inner surface 72 which can cause the flexible resilience of the mounting of that intumescent pad with respect to penetrating cables 18 and achieve the purpose of the present invention while only including a single plate.

The extent of movement of the individual plate 68 away from the adjacent walls 26, 28, 30 or 32 or away from the adjacent panel members 66 can be achieved by the inclusion of a stop means 98. Stop means 98 is merely a tab or bracket which limits the extent of movement of either of the plates from the adjacent portion of the sleeve in order to prevent excessive over extension of the spring means 76. These stop means are best shown in FIG. 1.

The present invention also preferably includes an upper overlapping flange 100 and a lower overlapping flange 102. These flanges are designed to seal the apparatus of the present invention between the individual plates 68 and the adjacent wall surface. More particularly the upper overlapping flange 100 is designed to extend downwardly to a position further than the possible extent of movement of the first plate member 82 and in this manner effectively create a seal to prevent movement of fire, heat or smoke through the area within sleeve 20 defined between the first outer surface 84 of first plate member 82 and the upper wall member 26. Similarly the lower overlapping flange 102 is designed to seal between the second outer surface 90 of second plate member 88 and the lower wall member 28. Preferably the upper overlapping flange means 100 and the lower overlapping flange means 102 will include a member on both opposite ends of the sleeve 20 to facilitate prevention of fluid flow or heat transmission or fire flow between the plates 68 and the adjacent wall members. Arrows 104 in FIG. 1 show the possible directions of movement of the first plate member 82 and the second plate member 88 within the sleeve 20.

In an alternative configuration of the present invention as shown in FIG. 5 the configuration of the flexibly resilient support means 74 can comprise leaf springs or flat springs 80. For convenience of manufacture these springs can be punched from the basic overall flat design or structure of the individual plate members 82 and 88.

To further enhance engagement of the intumescent pads 40 and 44 with respect to the penetrating cable members 18 biasing means can be positioned between the adjacent surface of the plate 68 and the pads themselves. In particular as shown in FIG. 1, an upper biasing means 62 can be positioned between the first inner surface 86 of first plate member 82 and the upper intumescent pad means 44 for urging thereof into further engaging abutment or contact with respect to penetrating cables 18 extending through the access corridor 22. Similarly a lower biasing means 64 can be included attached with respect to the second inner surface 92 of second plate member 88 for urging upwardly biasing thereby as shown in FIG. 1 against the lower intumescent pad means 38 to facilitate the urging of bias from beneath against penetrating cables 18 thereby. In this manner more firm securement and sealing around the penetrating members 18 is possible.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A self-adjusting intumescent firestopping apparatus for selectively sealing of an opening in a construction barrier having penetrating members extending therethrough comprising:

A. a sleeve means securable to the construction barrier at a position extending through the opening defined therein for defining an access corridor means extending through the barrier, said sleeve means including a plurality of panel members which together define said access corridor means therebetween;

B. a plate means extending along said panel members and movably attached with respect thereto, said plate means being positioned spatially disposed from said panel members, said plate means including an outer surface and an inner surface defined oppositely with respect to one another thereupon, said inner surface of said plate means along with said panel members defining said access corridor means therebetween;

C. an intumescent sealing means attached with respect to said inner surface of said plate means, said intumescent sealing means being positioned within said access corridor means extending between said inner surface of said plate means and the penetrating means for abutting engagement therewith to facilitate sealing of said access corridor therearound, said intumescent sealing means further comprising:

(1) a lower intumescent pad means positioned extending at least partially along said panel members within said access corridor means beneath the penetrating members; and (2) an upper intumescent pad means attached with respect to said inner surface of said plate means and movable therewithin, said upper intumescent pad means extending downwardly from said plate means into abutting engagement with respect to the penetrating members for sealing of said access corridor means above the penetrating members; and D. a flexibly resilient support means attached with respect to said outer surface of said plate means and positioned extending between at least one of said panel members and said outer surface of said plate means for facilitating flexibly resilient movable mounting of said plate means with respect to said sleeve means, said flexibly resilient support means adapted to exert force against said outer surface of said plate means to urge said inner surface of said plate means into abutment with respect to said intumescent sealing means for urging thereof into abutment with respect to penetrating members positioned extending through said access corridor means to facilitate sealing therearound.

2. A self-adjusting intumescent firestopping apparatus for selectively sealing of an opening in a construction barrier having penetrating members extending therethrough as defined in claim 1 wherein said flexibly resilient support means comprises a spring means.

3. A self-adjusting intumescent firestopping apparatus for selectively sealing of an opening in a construction barrier having penetrating members extending therethrough as defined in claim 2 wherein said spring means comprises a plurality of coil springs.

4. A self-adjusting intumescent firestopping apparatus for selectively sealing of an opening in a construction barrier having penetrating members extending therethrough as defined in claim 2 wherein said spring means comprises a plurality of flat springs.

5. A self-adjusting intumescent firestopping apparatus for selectively sealing of an opening in a construction barrier having penetrating members extending therethrough as defined in claim 4 wherein said flat springs are integrally formed from said plate means.

6. A self-adjusting intumescent firestopping apparatus for selectively sealing of an opening in a construction barrier having penetrating members extending therethrough as defined in claim 1 wherein said upper intumescent pad means includes an upper central pad section which is flexibly resilient and extends downwardly from said inner surface of said plate means toward said lower intumescent pad means therebelow to define a confinement area therebetween capable of abutting and holding of penetrating members extending therethrough by exerting force thereagainst.

7. A self-adjusting intumescent firestopping apparatus for selectively sealing of an opening in a construction barrier having penetrating members extending therethrough as defined in claim 1 wherein said lower intumescent pad means and said upper intumescent pad means are capable of completely sealing said access corridor means around the penetrating members extending therethrough responsive to heating thereof.

8. A self-adjusting intumescent firestopping apparatus for selectively sealing of an opening in a construction barrier having penetrating members extending therethrough as defined in claim 1 wherein said plate means further includes:

A. a first plate member extending along said panel members of said sleeve means at a position spatially disposed therefrom and movably attached with respect thereto, said first plate member including a first outer surface and a first inner surface defined oppositely with respect to one another thereupon; and B. a second plate member extending along said panel members of said sleeve means at a position spatially disposed therefrom and movably attached with respect thereto, said second plate being positioned oppositely from said first plate with respect to the penetrating members with the penetrating members positioned therebetween, said second plate member including a second outer surface and a second inner surface defined oppositely with respect to one another thereupon, said first inner surface of said first plate member and said second inner surface of said second plate member along with said panel members of said sleeve means defining said access corridor means therebetween for receiving the penetrating members extending therethrough.

9. A self-adjusting intumescent firestopping apparatus for selectively sealing of an opening in a construction barrier having penetrating members extending therethrough as defined in claim 8 wherein said sleeve means includes:

A. an upper wall member with said first plate member movably attached with respect thereto, said first plate member being movable approximately vertically downwardly with respect thereto to facilitate engaging abutment of said intumescent sealing means with respect to penetrating members extending through said access corridor means; and B. a lower wall member with said second plate member movable attached with respect thereto, said second plate member being movable approximately vertically upwardly with respect thereto to facilitate engaging abutment of said intumescent sealing means with respect to penetrating members extending through said access corridor means.

10. A self-adjusting intumescent firestopping apparatus for selectively sealing of an opening in a construction barrier having penetrating members extending therethrough as defined in claim 9 wherein said intumescent sealing means comprises:

A. an upper intumescent pad means attached with respect to said first inner surface of said first plate means and movable therewithin, said upper intumescent pad means extending downwardly from said first inner surface of said first plate means into abutting engagement with respect to the penetrating members from above for sealing of said access corridor means above the penetrating members; and B. a lower intumescent pad means attached with respect to said second inner surface of said second plate means and movable therewithin, said lower intumescent pad means extending upwardly from said second inner surface of said second plate means into abutting engagement with respect to the penetrating members from below for sealing of said access corridor means below the penetrating members.

11. A self-adjusting intumescent firestopping apparatus for selectively sealing of an opening in a construction barrier having penetrating members extending therethrough as defined in claim 10 wherein said upper intumescent pad means includes an upper central pad section which is flexibly resilient and extends downwardly from said first inner surface of said first plate means toward said lower intumescent pad means therebelow to define a confinement area therebetween capable of abutting and holding of penetrating members extending therethrough by exerting force thereagainst and wherein said lower intumescent pad means includes a lower central pad section which is flexibly resilient and extends upwardly from said second inner surface of said second plate means toward said upper intumescent pad means thereabove to further facilitate defining of a confinement area therebetween capable of abutting and holding of penetrating members extending therethrough by exerting force thereagainst.

12. A self-adjusting intumescent firestopping apparatus for selectively sealing of an opening in a construction barrier having penetrating members extending therethrough as defined in claim 10 wherein said flexibly resilient support means comprises a spring means.

13. A self-adjusting intumescent firestopping apparatus for selectively sealing of an opening in a construction barrier having penetrating members extending therethrough as defined in claim 10 wherein said flexibly resilient support means comprises:

A. an upper spring means mounted to said upper wall member and extending downwardly therefrom, said upper spring means also being secured to said first outer surface of said first plate member to facilitate flexibly resilient mounting thereof with respect to said sleeve means; and B. a lower spring means mounted to said lower wall member and extending upwardly therefrom, said lower spring means also being secured to said second outer surface of said second plate member to facilitate flexibly resilient mounting thereof with respect to said sleeve means.

14. A self-adjusting intumescent firestopping apparatus for selectively sealing of an opening in a construction barrier having penetrating members extending therethrough as defined in claim 13 wherein said upper spring means and said lower spring means each are coil springs.

15. A self-adjusting intumescent firestopping apparatus for selectively sealing of an opening in a construction barrier having penetrating members extending therethrough as defined in claim 13 wherein said upper spring means and said lower spring means each are flat springs.

16. A self-adjusting intumescent firestopping apparatus for selectively sealing of an opening in a construction barrier having penetrating members extending therethrough as defined in claim 10 wherein said upper intumescent pad means and said lower intumescent pad means are both provided in the form of a foam pad.

17. A self-adjusting intumescent firestopping apparatus for selectively sealing of an opening in a construction barrier having penetrating members extending therethrough as defined in claim 10 further comprising an upper biasing means positioned between said upper wall member and said upper intumescent pad means to exert downwardly directed bias against said upper intumescent pad means to facilitate engagement thereof with respect to penetrating members extending through the opening for enhancing retaining thereof and a lower biasing means positioned between said lower wall member and said lower intumescent pad means to exert upwardly directed bias against said lower intumescent pad means to facilitate engagement thereof with respect to penetrating members extending through the opening for enhancing retaining thereof.

18. A self-adjusting intumescent firestopping apparatus for selectively sealing of an opening in a construction barrier having penetrating members extending therethrough as defined in claim 9 further comprising an upper overlapping flange means extending downwardly from said upper wall member to seal the portion of said sleeve means extending between said first outer surface of said first plate member and said upper wall member and further comprising a lower overlapping flange means extending upwardly from said lower wall member to seal the portion of said sleeve means extending between said second outer surface of said second plate member and said lower wall member.

19. A self-adjusting intumescent firestopping apparatus for selectively sealing of an opening in a construction barrier having penetrating members extending therethrough as defined in claim 1 wherein said lower intumescent pad means and said upper intumescent pad means are longitudinally longer than said sleeve means to facilitate engaging abutment thereof with respect to penetrating members extending through said access corridor means.

20. A self-adjusting intumescent firestopping apparatus for selectively sealing of an opening in a construction barrier having penetrating members extending therethrough as defined in claim 1 further comprising a stop means attached with respect to said sleeve means and adapted to be engagable with respect to said plate means to limit the extent of movement thereof away from said panel means.

21. A self-adjusting intumescent firestopping apparatus for selectively sealing of an opening in a construction barrier having penetrating members extending therethrough comprising:

A. a sleeve means securable to the construction barrier at a position extending through the opening defined therein for defining an access corridor means extending through the barrier, said sleeve means including a plurality of panel members which together define said access corridor means therebetween, said sleeve means including:

(1) an upper wall member positioned generally above said access corridor means and the penetrating members extending therethrough;

(2) a lower wall member positioned generally below said upper wall member and generally below said access corridor means and the penetrating members extending therethrough;

B. a plate means extending along said panel members and movably attached with respect thereto, said plate means being positioned spatially disposed from said panel members, said plate means including an outer surface and an inner surface defined oppositely with respect to one another thereupon, said inner surface of said plate means along with said panel members defining said access corridor means therebetween, said plate means further including:

(1) a first plate member movably attached with respect to said upper wall member and extending along said panel members of said sleeve means at a position spatially disposed therefrom and movably attached with respect thereto, said first plate member including a first outer surface and a first inner surface defined oppositely with respect to one another thereupon, said first plate member being movable approximately vertically downwardly with respect to said upper wall member;

(2) a second plate member movably attached with respect to said lower wall member and extending along said panel members of said sleeve means at a position spatially disposed therefrom and movably attached with respect thereto, said second plate being positioned oppositely from said first plate with respect to the penetrating members with the penetrating members positioned therebetween, said second plate member including a second outer surface and a second inner surface defined oppositely with respect to one another thereupon, said first inner surface of said first plate member and said second inner surface of said second plate member along with said panel members of said sleeve means defining said access corridor means therebetween for receiving the penetrating members extending therethrough, said second plate member being movable approximately vertically upwardly with respect to said lower wall member;

C. an intumescent sealing means attached with respect to said inner surface of said plate means, said intumescent sealing means being positioned within said access corridor means extending between said inner surface of said plate means and the penetrating means for abutting engagement therewith to facilitate sealing of said access corridor therearound, said first plate member being movable approximately vertically downwardly with respect to said upper wall member to facilitate engaging abutment of said intumescent sealing means with respect to penetrating members extending through said access corridor means, said second plate member being movable approximately vertically upwardly with respect to said lower wall member to facilitate engaging abutment of said intumescent sealing means with respect to penetrating members extending through said access corridor means, said intumescent sealing means comprising:

(1) an upper intumescent pad means attached with respect to said first inner surface of said first plate means and movable therewithin, said upper intumescent pad means extending downwardly from said first inner surface of said first plate means into abutting engagement with respect to the penetrating members from above for sealing of said access corridor means above the penetrating members;

(2) a lower intumescent pad means attached with respect to said second inner surface of said second plate means and movable therewithin, said lower intumescent pad means extending upwardly from said second inner surface of said second plate means into abutting engagement with respect to the penetrating members from below for sealing of said access corridor means below the penetrating members; and D. a flexibly resilient support means attached with respect to said outer surface of said plate means and positioned extending between at least one of said panel members and said outer surface of said plate means for facilitating flexibly resilient movable mounting of said plate means with respect to said sleeve means, said flexibly resilient support means adapted to exert force against said outer surface of said plate means to urge said inner surface of said plate means into abutment with respect to said intumescent sealing means for urging thereof into abutment with respect to penetrating members, positioned extending through said access corridor means to facilitate sealing therearound, said flexibly resilient support means comprising:

(1) an upper spring means mounted to said upper wall member and extending downwardly therefrom, said upper spring means also being secured to said first outer surface of said first plate member to facilitate flexibly resilient mounting thereof with respect to said sleeve means; and (2) a lower spring means mounted to said lower wall member and extending upwardly therefrom, said lower spring means also being secured to said second outer surface of said second plate member to facilitate flexibly resilient mounting thereof with respect to said sleeve means.

22. A self-adjusting intumescent firestopping apparatus for selectively sealing of an opening in a construction barrier having penetrating members extending therethrough comprising:

A. a sleeve means securable to the construction barrier at a position extending through the opening defined therein for defining an access corridor means extending through the barrier, said sleeve means including a plurality of panel members which together define said access corridor means therebetween, said sleeve means including:

(1) an upper wall member positioned generally above said access corridor means and the penetrating members extending therethrough;

(2) a lower wall member positioned generally below said upper wall member and generally below said access corridor means and the penetrating members extending therethrough;

B. a plate means extending along said panel members and movably attached with respect thereto, said plate means being positioned spatially disposed from said panel members, said plate means including an outer surface and an inner surface defined oppositely with respect to one another thereupon, said inner surface of said plate means along with said panel members defining said access corridor means therebetween, said plate means further including:

(1) a first plate member movably attached with respect to said upper wall member and extending along said panel members of said sleeve means at a position spatially disposed therefrom and movably attached with respect thereto, said first plate member including a first outer surface and a first inner surface defined oppositely with respect to one another thereupon, said first plate member being movable approximately vertically downwardly with respect to said upper wall member;

(2) a second plate member movably attached with respect to said lower wall member and extending along said panel members of said sleeve means at a position spatially disposed therefrom and movably attached with respect thereto, said second plate being positioned oppositely from said first plate with respect to the penetrating members with the penetrating members positioned therebetween, said second plate member including a second outer surface and a second inner surface defined oppositely with respect to one another thereupon, said first inner surface of said first plate member and said second inner surface of said second plate member along with said panel members of said sleeve means defining said access corridor means therebetween for receiving the penetrating members extending therethrough, said second plate member being movable approximately vertically upwardly with respect to said lower wall member;

C. an intumescent sealing means attached with respect to said inner surface of said plate means, said intumescent sealing means being positioned within said access corridor means extending between said inner surface of said plate means and the penetrating means for abutting engagement therewith to facilitate sealing of said access corridor therearound, said first plate member being movable approximately vertically downwardly with respect to said upper wall member to facilitate engaging abutment of said intumescent sealing means with respect to penetrating members extending through said access corridor means, said second plate member being movable approximately vertically upwardly with respect to said lower wall member to facilitate engaging abutment of said intumescent sealing means with respect to penetrating members extending through said access corridor means, said intumescent sealing means comprising:

(1) an upper intumescent pad means attached with respect to said first inner surface of said first plate means and movable therewithin, said upper intumescent pad means extending downwardly from said first inner surface of said first plate means into abutting engagement with respect to the penetrating members from above for sealing of said access corridor means above the penetrating members, said upper intumescent pad means including an upper central pad section which is flexibly resilient and extends downwardly from said first inner surface of said first plate means toward said lower intumescent pad means therebelow to define a confinement area therebetween capable of abutting and holding of penetrating members extending therethrough by exerting force thereagainst, said upper intumescent pad means being longitudinally longer than said sleeve means to facilitate engaging abutment thereof with respect to penetrating members extending through said access corridor means;

(2) a lower intumescent pad means attached with respect to said second inner surface of said second plate means and movable therewithin, said lower intumescent pad means extending upwardly from said second inner surface of said second plate means into abutting engagement with respect to the penetrating members from below for sealing of said access corridor means below the penetrating members, said lower intumescent pad means including a lower central pad section which is flexibly resilient and extends upwardly from said second inner surface of said second plate means toward said upper intumescent pad means thereabove to further facilitate defining of a confinement area therebetween capable of abutting and holding of penetrating members extending therethrough by exerting force thereagainst, said lower intumescent pad means being longitudinally longer than said sleeve means to facilitate engaging abutment thereof with respect to penetrating members extending through said access corridor means;

D. a flexibly resilient support means attached with respect to said outer surface of said plate means and positioned extending between at least one of said panel members and said outer surface of said plate means for facilitating flexibly resilient movable mounting of said plate means with respect to said sleeve means, said flexibly resilient support means adapted to exert force against said outer surface of said plate means to urge said inner surface of said plate means into abutment with respect to said intumescent sealing means for urging thereof into abutment with respect to penetrating members, positioned extending through said access corridor means to facilitate sealing therearound, said flexibly resilient support means comprising:

(1) an upper spring means mounted to said upper wall member and extending downwardly therefrom, said upper spring means also being secured to said first outer surface of said first plate member to facilitate flexibly resilient mounting thereof with respect to said sleeve means, said upper spring means comprising a plurality of coil springs;

(2) a lower spring means mounted to said lower wall member and extending upwardly therefrom, said lower spring means also being secured to said second outer surface of said second plate member to facilitate flexibly resilient mounting thereof with respect to said sleeve means, said lower spring means comprising a plurality of coil springs;

E. a stop means attached with respect to said sleeve means and adapted to be engagable with respect to said first plate member and said second plate member to limit the extent of movement thereof away from said panel means;

F. an upper overlapping flange means extending downwardly from said upper wall member to seal the portion of said sleeve means extending between said first outer surface of said first plate member and said upper wall member;

G. a lower overlapping flange means extending upwardly from said lower wall member to seal the portion of said sleeve means extending between said second outer surface of said second plate member and said lower wall member;

H. an upper biasing means positioned between said upper wall member and said upper intumescent pad means to exert downwardly directed bias against said upper intumescent pad means to facilitate engagement thereof with respect to penetrating members extending through the opening for enhancing retaining thereof; and I. a lower biasing means positioned between said lower wall member and said lower intumescent pad means to exert upwardly directed bias against said lower intumescent pad means to facilitate engagement thereof with respect to penetrating members extending through the opening for enhancing retaining thereof.

* * * * *